United States Patent [19]

Despins

[11] Patent Number: 4,484,976

[45] Date of Patent: Nov. 27, 1984

[54] SEALANT APPLICATOR FOR JOINING PLANAR MATERIALS

[75] Inventor: Maurice Despins, St. Albert, Canada

[73] Assignee: Omniart Distributions Inc., Edmonton, Canada

[21] Appl. No.: 506,601

[22] Filed: Jun. 22, 1983

[51] Int. Cl.[3] ..... B65C 11/04

[52] U.S. Cl. ..... 156/578; 156/304.1; 156/304.7; 156/546; 156/579

[58] Field of Search ..... 156/304.1, 304.3, 304.4, 156/304.7, 544–546, 578, 579; 118/410

[56] References Cited

U.S. PATENT DOCUMENTS

| | | | |
|---|---|---|---|
| 1,924,523 | 8/1933 | Spring | 156/578 X |
| 1,924,551 | 8/1953 | Higgins | 156/578 X |
| 2,307,280 | 1/1943 | Krasno | 156/578 X |
| 2,701,003 | 2/1955 | Kamborian | 156/479 |
| 3,099,582 | 7/1963 | Ongstad et al. | 156/578 X |
| 3,279,971 | 10/1966 | Gardener | 156/304.3 X |

*Primary Examiner*—David Simmons
*Attorney, Agent, or Firm*—Murray Schaffer

[57] ABSTRACT

Applicator tools for joining seams in floor and wall coverings are provided. The seams created by the tools disclosed are stronger, of better appearance, and provide a longer seam life. The applicator tools disclosed include means to engage a container of sealant, the tool having a foot at one end, with a leg portion above the foot of the relatively narrow cross-section, whereby the foot may be passed under the edges of the materials being joined. A conduit communicates with the sealant container, and with openings in or near the foot, to ensure effective sealant application to the materials being joined, both under the edges of the material, and on the edges of the material itself.

7 Claims, 13 Drawing Figures

SEALANT APPLICATOR FOR JOINING PLANAR MATERIALS

The invention deals with applicator tools for making permanently joined seams in floor and wall coverings, which seams are stronger, better in appearance, and of longer life, than seams made by any means known in the prior art. The invention is also believed to be more practical and convenient to use than other flooring applicator tools.

Prior art techniques for joining seams in flooring and similar materials have failed to provide a positive means of opening the seam between the material being joined, nor does prior art apparatus permit a positive means of wetting the edges of the flooring material being joined, with a sealant solution. Some prior art seam joining techniques utilize applicators that move the flooring materials apart only by a downward force on a tool having a knife-like member projecting from the bottom thereof, which requires a strong downward force on the tool, and its projection, while the flooring materials are flat on the floor. It has proved moderately practical to use this type of prior art apparatus only with cushioned vinyl flooring material which is a relatively soft material. The gap force in material such as cushioned vinyl flooring, however, is of relatively short length, and consequently the joining solution which must be used must have a much higher solvent content, as opposed to the longer seam gap created by the subject apparatus, during operation, which permits use of a joining solution having a relatively low solvent content.

One of the advantages of applicant's invention therefore is that joining solution may incorporate the same base material as the flooring material or other material being joined, and have a relatively high content of this material, and pigment, relative to the quantity of solvent employed in the joining solution. Following seaming of material with applicant's apparatus, therefore, all of the solvent will relatively quickly evaporate from the joint created, and the seam so created becomes indistinguishable in appearance, from the adjacent material. Such seam, in addition, has the same strength as the flooring material and is equally waterproof. Joints made with other available apparatus generally retain a clearly visible seam, and moreover, the seams so created are not as strong.

If prior art seaming apparatus is used with a joining solution having a relatively low viscosity, such solution will not flow to an adequate depth in the seam of the material being joined, because the seam is open for such a relatively short time, and for such a relatively short length at any moment in time, which results in a seam with much of the joining solution on the top surface of the material being joined, where it is quickly worn off.

With prior art apparatus flooring materials other than cushioned vinyl cannot effectively be forced apart to produce a seam gap, and it is common practice to pour joining solution on the top of the closed seam of the flooring material. The amount of joining solution that penetrates the seam is little or none, and the joining solution on top of the flooring material is worn off quickly because it protrudes upwardly.

Another method of joining flooring or similar materials is by the use of an applicator tool which heats and melts the edges of the flooring or other materials, filling the seam gap with melted filler rod. A seam made by this method is so wide and discoloured that it is often necessary to arrange the seams so that they occur in a portion of a pattern, in an effort to camouflage the visible seam. Further, with heat seaming, there is difficulty controlling tool temperatures during application, and joints may be made at too high a temperature resulting in scorched and widened seams; or the joints are made at too low a temperature resulting in inadequate fusion of the filler rod to the flooring material.

Another method of joining flooring material seams is with the application of epoxy to the sub-flooring. The epoxy is applied to the sub-floor in a band that is several thicknesses of the flooring material wide on each side of the seam, and the flooring materials are then pressed onto the sub-floor. Some of the epoxy is thereby forced into the seam to bond the flooring materials together. The seam bond between the epoxy and the flooring materials, however, are not waterproof, the bond between the epoxy and the flooring material is relatively weak, and because epoxy is much stiffer than the flooring material the bond between the two often breaks under traffic.

The seaming apparatus invented by applicant is believed to overcome all of the shortcomings of the prior art devices and methods of seaming floor and wall coverings and other similar materials.

A principal object of the invention is to provide a sealant applicator for joining planar materials comprising: a unitary body having means at one end adapted for engagement with a sealant container; said body having a foot at its end remote from said container-engaging means; said body having a leg portion between said container-engaging means and said foot, said leg being of smaller cross-section diemsnion than said foot; a conduit within said body communicating at one end with said container-engaging means and at its other end with said foot; whereby said foot may be moved under and along at least one edge of planar material and sealant applied thereto.

A description of the invention will now be made with reference to the accompanying drawings in which.

Detailed reference will now be made to the accompanying drawings wherein like reference numerals will identify like parts.

Figure 2:
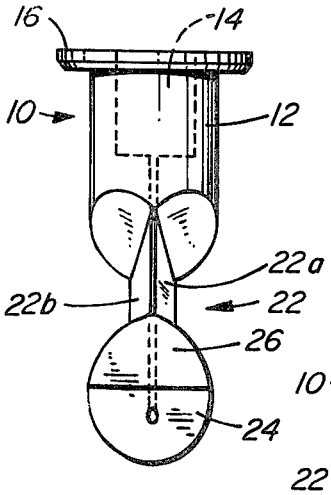
FIG. 2 is a front elevation of the apparatus of FIG. 1.

In FIGS. 1, 2, 3 and 4, a unitary sealant applicator for joining seams of planar material is indicated generally by the reference numeral 10. Applicator 10 has a body portion 12 having a central circular opening 14, and an upper, unitary circular flange 16 adapted to be engaged by a screw cap 18 (see FIG. 1) of a container 20, usually of flexible material as is well understood in the art, containing a supply of sealant composition.

Alternatively, flange 16 could be replaced by or include a unitary cap device, threaded internally, adapted for screw enagement with the mouth of a sealant container.

Projecting downwardly from body 12 of applicator 10 are unitary central leg 22, and foot 24.

Foot 24 has a smooth, flat, bottom surface, beveled upwardly at its leading edge 26 (see FIGS. 2 and 4), the upper surface of foot 24 slopes generally outwardly and downwardly away from the center thereof, these surfaces 28 and 30 effectively forming a wedge, in combination with the beveled leading bottom edge 26 thereof.

A tubular opening or conduit 32 communicates with the interior of sealant container 20 at its upper end, and opens at the bottom of leg 22 immediately above foot 24. A further tube-like opening 34 is provided in foot 24 immediately below and in alignment with tubular hole 32.

Figure 1:
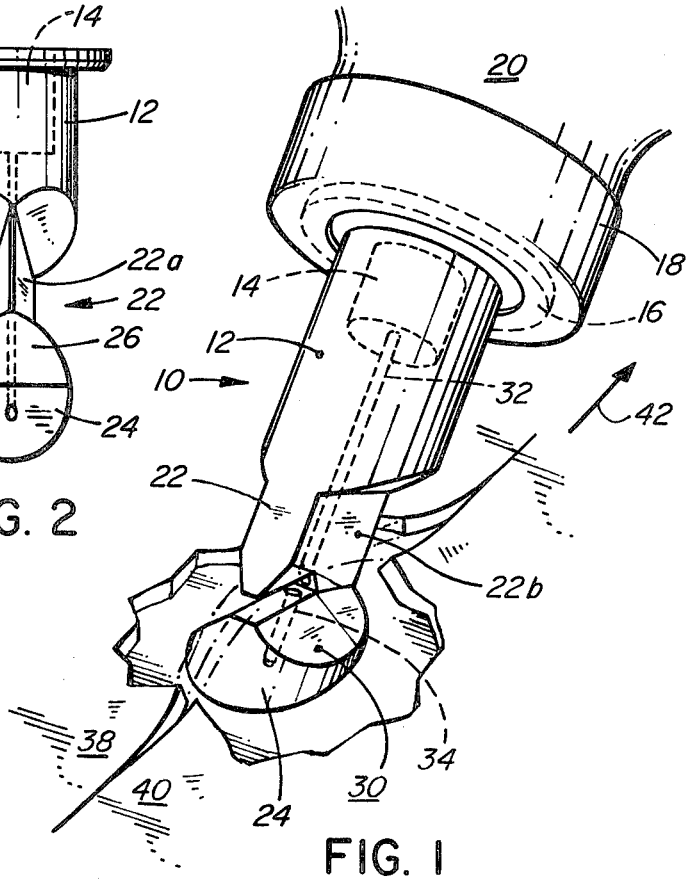
FIG. 1 is a perspective view of a sealant applicator according to the invention, in use with a portion of flooring also illustrated, and broken away.
Figure 3:
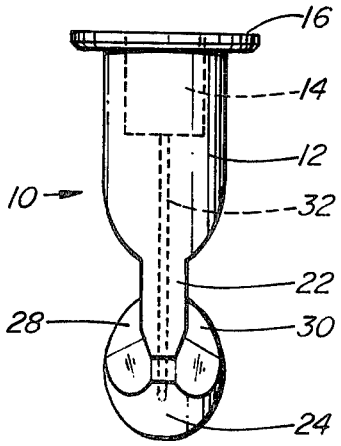
FIG. 3 is a rear elevation of the apparatus of FIG. 1.

As is seen most clearly in FIGS. 1 and 2, leg 22 is wedge shaped, having faces **22*a* and 22*b* at the bottom of the leading edge of leg 22. A rectangular notch 36 separates the trailing edges of foot 24 and leg 22**.

Referring to FIG. 1, the applicator tool is illustrated between elevated edges of two pieces of abutting flooring 38 and 40, being bonded by the applicator. The applicator is being manually advanced in the direction of arrow 42. As the applicator is moved in this direction, it will be seen that the edges of the two pieces of flooring materials 38 and 40 are lifted simultaneously by the wedging action of surfaces 28 and 30 of foot 24, causing the flooring materials to separate enough to enable a joining solution flowing through hole 32 from the sealant container 20 to fully wet each edge of the two pieces of flooring material 38, 40.

The tapered or wedge shaped sides **22*a* and 22*b* of leg 22 easily force the edges of material 38, 40 apart, as the applicator is advanced in the direction of arrow 42, and the tapered outer surfaces 28, 30, of foot 24 similarly assist in slight elevation of the flooring material 38, 40, as the applicator is moved. Sealant running from the end of tubular conduit 32 thus ensures effective contact with both edges of material 38, 40. Any excess sealant will tend to flow through tubular opening 34 of foot 24, to complement the sealant already wetting both edges of material 38, 40**.

The tapered toe 26 of bottom surface 24 ensures that the applicator will move relatively easily over any upward projections encountered on the sub-floor being traversed. The material being seamed should of course be pressed downwardly immediately behind the applicator's travel, to ensure good sealant contact therebetween.

The applicator just described will travel relatively easily without the operator exerting downward or other pressure, the top surfaces 28 and 30 of foot 24 preventing the applicator being inadvertently pulled out of the seam being formed, unless and until the two pieces of material 38, 40, are separated to a distance equal to the total width of foot 24, and in practice the accidental removal of the tool is very infrequent. The contrast with prior art devices now in use is dramatic, where the operator requires strong manual downward pressure in order to project sealant, however imperfectly, between the pieces of flooring materials being joined.

Figure 4:
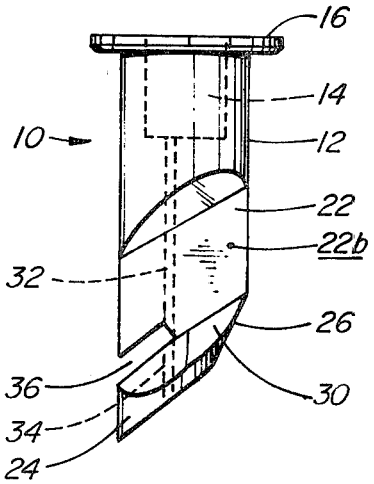
FIG. 4 is a side elevation of the apparatus of FIG. 1.
Figure 5:
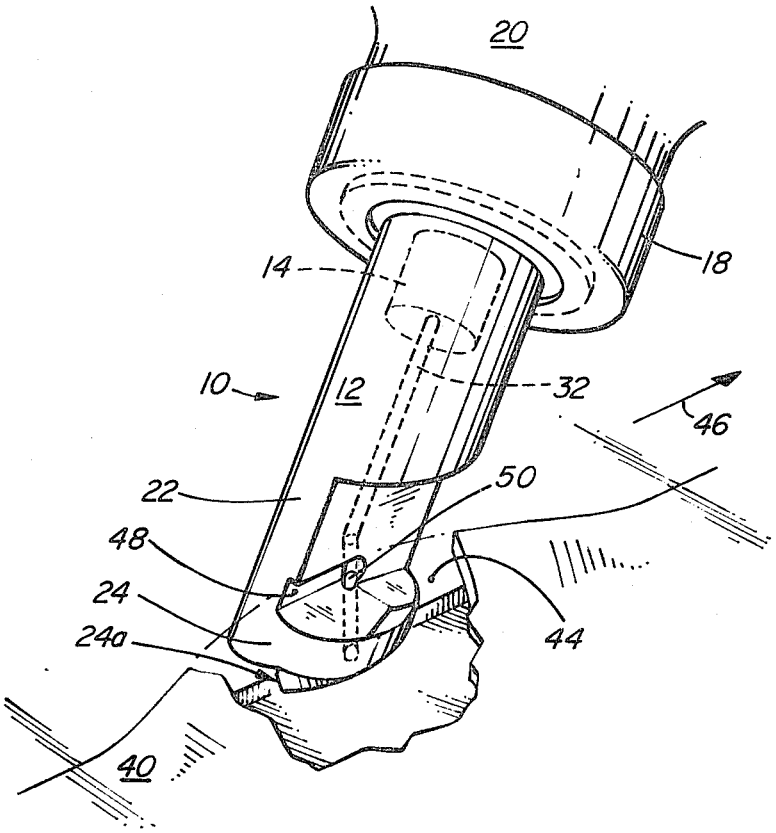
FIG. 5 is a perspective view of a sealant applicator for use adjacent a baseboard or base strip.
Figure 6:
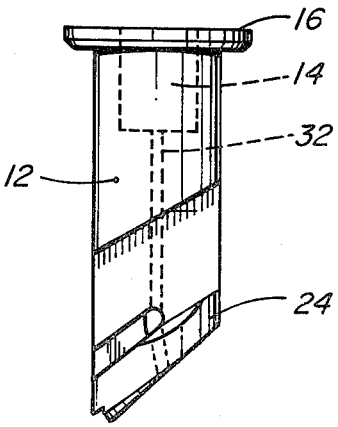
FIG. 6 is a side elevation of the apparatus of FIG. 5.
Figure 7:
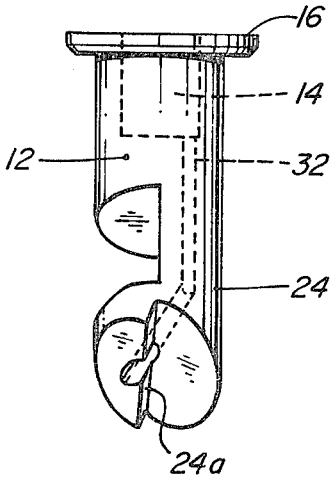
FIG. 7 is a front elevation of the apparatus of FIG. 5.
Figure 8:
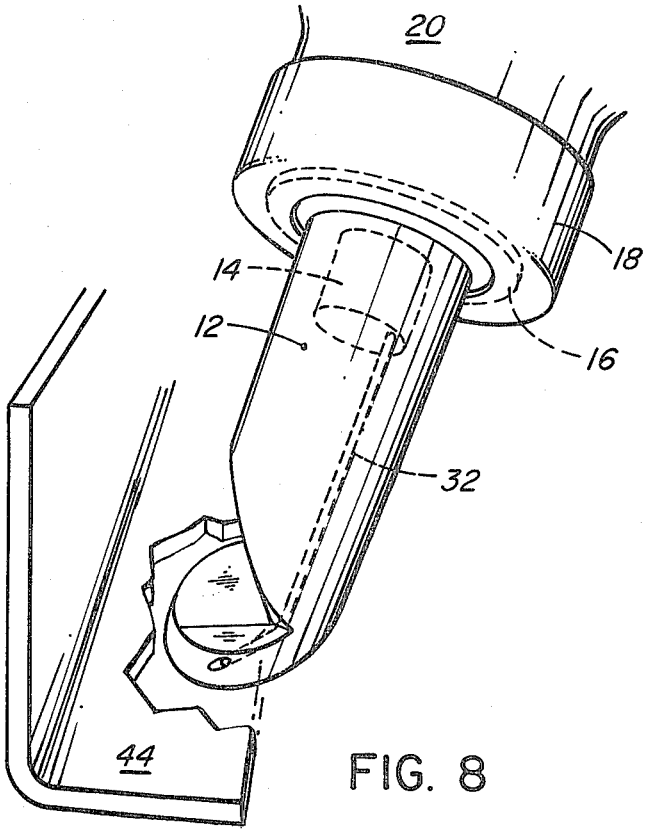
FIG. 8 is a perspective view of a sealant applicator for base strips.
Figure 9:
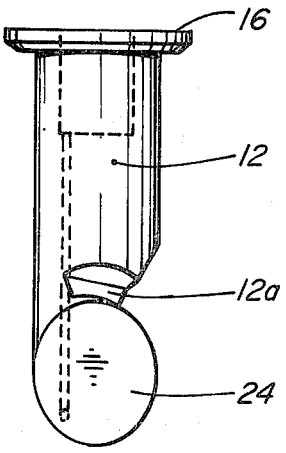
FIG. 9 is a side elevation of the apparatus of FIG. 10.
Figure 10:
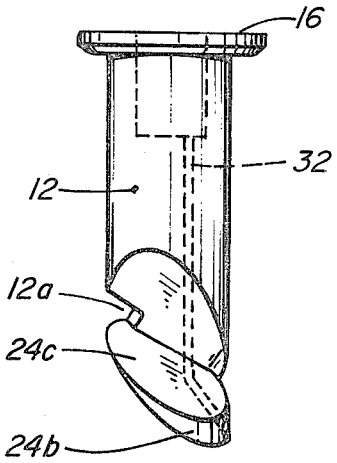
FIG. 10 is a front elevation of the apparatus of FIG. 8.

A modified applicator according to the invention is illustrated in FIGS. 5, 6 and 7, the applicator disclosed being adapted for use in bonding a flooring material to a base strip, baseboard, or the like, which has already been permanently glued to a wall or the like, base strip 44 being illustrated in FIG. 4, and flooring material 40, to be bonded in abutment thereto also being illustrated.

The applicator has been modified in its leg and foot configuration, as opposed to the embodiment of FIGS. 1 through 4. As is seen most clearly in FIG. 7 the bottom surface of foot 24 is stepped, so as to provide a vertical face **24*a* adapted to slide along the edge of base strip 44, to which flooring material 40 is to be affixed in close abutment. It will be further seen that foot 24 extends only on one side of leg 22, and has an upper surface thereabove over which flooring material is elevated, as the applicator is manually advanced in the direction of arrow 46. A recess 48 is provided in the trailing edge of leg 22 immediately above the top surface of foot 24 so as to engage the edge of material 40 as the applicator is advanced, and to ensure that the edge of material 40 is in full contact with the orifice 50 provided therein, through which sealant flows from container 20, as already described in connection with the embodiment of FIG. 1. It will be further noted that immediately below orifice 50, a tubular opening extends to the bottom of foot 24, and opens to the face 24*a* of the stepped side of foot 24. Thus, good sealant contact is ensured with the edge of material 40, through orifice 50, and with the edge of base strip 44. In this modified apparatus it will be seen that the applicator slides with certainty along the leading edge of base strip 44, and sealant is effectively applied to the edges of flooring material 40 and base strip 44**, so as to make a positive union therebetween.

The embodiment illustrated in FIGS. 8 through 12 is intended to facilitate the bonding of the bottom of a base strip onto a flooring material.

Figure 11:
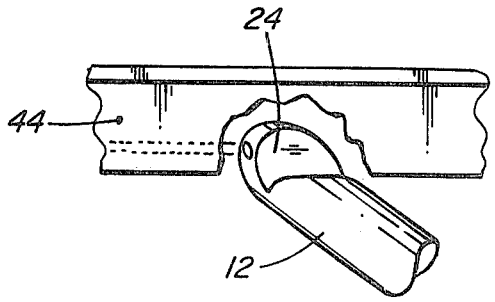
FIGS. 11 and 12 are top plans of the apparatus of FIG. 8.
Figure 12:
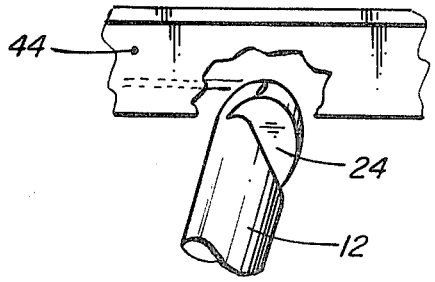

The configuration of leg 22 and foot 24 illustrated in FIGS. 8–12 have been modified for this purpose, and it will be seen that the bottom face of foot 24 is a flat oval (see FIG. 9), and has a tapered outer edge **24*b* (see FIG. 10), with a smooth flat upper face 24*c*. A notch 12*a* is provided at the base of leg 22, at the leading edge thereof. The tubular opening 32 communicates with the interior of sealant container 20 at its upper end and communicates only with the trailing edge of tapered foot 24, that is, at the widest part thereof, at its lower end. As is clearly illustrated in FIG. 8, foot 24 is adapted to project under a base strip 44 already in place, and an even stream of sealant projected thereunder. With reference to FIGS. 11 and 12, it will be seen that the applicator disclosed is useful for maintaining a continuous line of joining solution when encounterting an inside corner (because it is necessary to change the applicator tool orientation prior to arriving at the inner corner to avoid the end of the flexible bottle containing sealant fouling with the abutting wall before the line of joining solution is completed under base strip 44 when the applicator is shown as illustrated in FIG. 11). When the applicator is rotated to the relative position illustrated in FIG. 12**, however, it will be appreciated that an inside corner can be readily negotiated.

Figure 13:
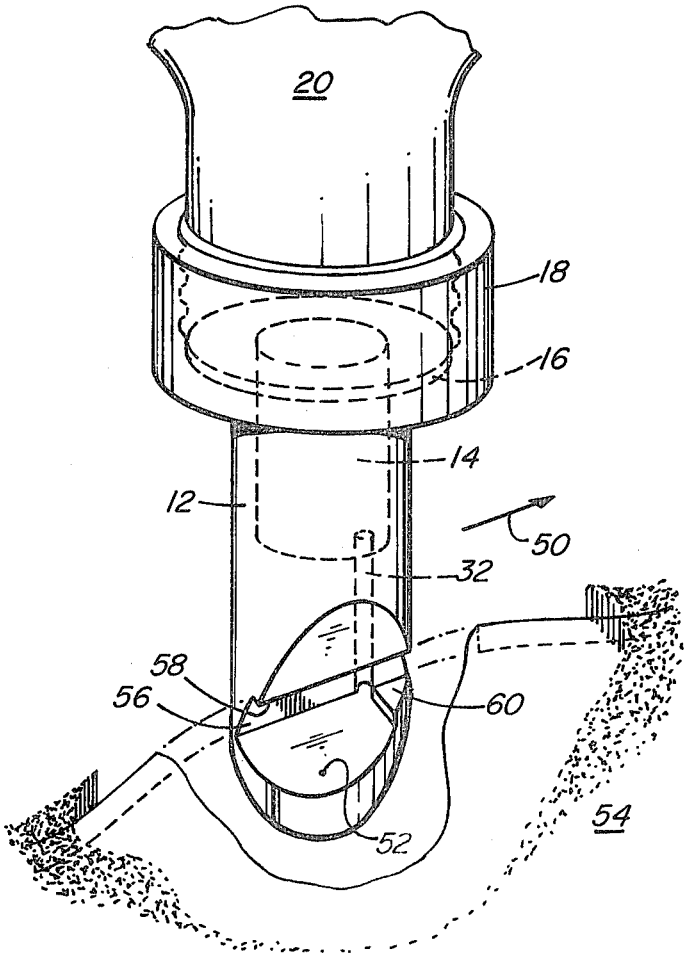
FIG. 13 is a perspective view of a sealant applicator for carpet edges.

The embodiment illustrated in FIG. 13 is another modified version of the applicator designed specifically to apply glue or sealant to the edge of a carpet more uniformly and more conveniently than any other applicator. When carpet is being laid on large floors it is often necessary to cut pieces of carpet to size and then to join them together. Carpet which has a woven backing can often have the piling unraveled from the backing at an edge which has been cut unless the piling and backing are glued together at the edge soon after the cut has been made. With conventional applicator tools it is necessary to lift the edge of the carpet up several inches above the sub-floor in order to apply glue or sealant to the edge, this movement of the carpet often encouraging unraveling to occur. The applicator illustrated in FIG. 13 eliminates the need to raise the carpet, and greatly facilitates the application of glue or sealant to a cut edge thereof. The applicator illustrated in FIG. 13 applies glue or sealant not only to the edge of a carpet, but to the bottom edges of the fibres to ensure good adhesion thereof.

The applicator illustrated in FIG. 13 is manually glued in the direction of arrow 50, with its foot 52 under laid carpet 54, the edge of carpet 54 pressing against vertical inner edge 56 of a short leg portion which includes an upper surface 58, adapted to ride on top of the piling of carpet 54, thus preventing the edge of the carpet 54 from riding upwardly. Glue or sealant flows through conduit 32 which communicates with the inner edge of leg surface 56, as illustrated, and conduit 32 continues through foot 52 to the bottom thereof ensuring an even application of sealant along the carpet edge and therebelow, the leading edge of carpet 54 to which sealant is being applied being slightly elevated by elevated, stepped surface 60 of foot 52.

The glue or sealant tends in fact to flow upwardly as the edge of the carpet is treated in the manner discussed. That is, the glue or sealant flows on and into the piling in order to ensure that it is secured to the carpet backing, without the glue or sealant flowing to the top of the piling itself, and thus there is no visual trace of the sealant on the top surface of carpet 54, following its application thereto.

When the carpet edges have had glue or sealant applied thereto, the applicator of FIG. 13 is removed, and the carpet may then be joined to adjacent carpet pieces, by conventional means.

The applicator of FIG. 13 may also be employed when carpet is to be laid on underpad or the like, or when carpeting is to be glued directly to sub-flooring.

The foregoing is by way of example only and the invention should be limited only by the scope of the appended claims.

The embodiments of the invention in which an exclusive property or privilege is claimed are defined as follows:

1. A sealant applicator for joining the edges of two abutting planar materials comprising:

a unitary body having means at one end adapted for engagement with a sealant container;

said body having a foot at its end remote from said container-engaging means;

said body having a leg portion between said container-engaging means and said foot, said leg being of smaller cross-section dimension than said foot and said foot having an upper surface extending laterally of said leg at an angle to the axis of the leg;

a conduit within said body communicating at one end with said container-engaging means and opening at its other end at least on the upper surface of said foot;

said body being positionable with the leg between the adjacent edges of one of said planar materials, the foot inserted beneath the under surface of at least one of said planar materials and sealant applied thereto on movement of said body along the abutting edges.

2. A sealant applicator according to claim 1, said leg depending centrally on said body and having a triangular, wedge-shaped cross-section, and said foot having a smooth, oval bottom surface with its leading edge being upwardly beveled.

3. A sealant applicator according to claim 1, said leg depending from one side of said body and being semicircular in cross-section; said foot having a smooth, oval bottom surface, and said conduit communicating with the trailing edge of the foot.

4. A sealant applicator according to claim 1, said leg depending from one side of said body and being semicircular in cross section; said foot having a centrally stepped bottom surface; and said conduit communicating with the bottom of said foot, centrally at said step.

5. A sealant applicator according to claim 1, said means for engagement with a sealant container comprising a unitary flange.

6. A sealant applicator according to claim 1, said means for engagement with a sealant container comprising a unitary screw cap.

7. A sealant applicator according to claim 2, said triangular, wedge-shaped leg having a notch in its trailing side immediately above said foot; said conduit communicating with the inner end of said notch above said foot and said foot having a vertical conduit extending therethrough in alignment with said first-named conduit.

* * * * *